US009995130B2

(12) United States Patent
O'Brien

(10) Patent No.: US 9,995,130 B2
(45) Date of Patent: Jun. 12, 2018

(54) COMPLETION SYSTEM AND METHOD FOR COMPLETING A WELLBORE

(71) Applicant: Robert S. O'Brien, Katy, TX (US)

(72) Inventor: Robert S. O'Brien, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 300 days.

(21) Appl. No.: 13/930,963

(22) Filed: Jun. 28, 2013

(65) Prior Publication Data

US 2015/0000932 A1 Jan. 1, 2015

(51) Int. Cl.

| | |
|---|---|
| ***E21B 47/00*** | (2012.01) |
| ***E21B 23/03*** | (2006.01) |
| ***E21B 43/00*** | (2006.01) |

(52) U.S. Cl.

CPC ..... *E21B 47/00* (2013.01); *E21B 43/00* (2013.01); *E21B 23/03* (2013.01)

(58) Field of Classification Search

CPC ..... E21B 47/06; E21B 23/03; E21B 47/00; E21B 47/01; E21B 33/072

See application file for complete search history.

(56) References Cited

U.S. PATENT DOCUMENTS

| | | | | |
|---|---|---|---|---|
| 3,665,955 | A * | 5/1972 | Conner, Sr. | E21B 17/02 137/495 |
| 4,557,325 | A * | 12/1985 | Gall | 166/97.1 |
| 5,207,272 | A * | 5/1993 | Pringle | E21B 17/06 166/120 |
| 5,574,263 | A * | 11/1996 | Roesner | 181/102 |
| 6,360,820 | B1 * | 3/2002 | Laborde et al. | 166/66 |
| 6,464,004 | B1 * | 10/2002 | Crawford et al. | 166/250.01 |
| 2003/0234110 | A1 * | 12/2003 | McGregor | 166/373 |
| 2010/0132955 | A1 * | 6/2010 | Storm et al. | 166/377 |
| 2012/0081699 | A1 * | 4/2012 | Ford et al. | 356/128 |
| 2012/0325484 | A1 * | 12/2012 | Patel | E21B 34/14 166/308.2 |
| 2013/0110402 | A1 * | 5/2013 | Godager | 702/7 |
| 2013/0255961 | A1 * | 10/2013 | Frisby | E21B 33/12 166/373 |

* cited by examiner

*Primary Examiner* — Kipp C Wallace
(74) *Attorney, Agent, or Firm* — Cantor Colburn LLP

(57) ABSTRACT

In one aspect, a system includes a casing disposed in a wellbore in a formation, an installed tubular disposed within the casing and a treatment tubular disposed within the installed tubular, wherein no control line is provided in the treatment tubular, installed tubular or casing. The system also includes a communication line that is placed within the treatment tubular after the treatment tubular is positioned in the wellbore, wherein the communication line has a sensor to be placed proximate an area of interest within the treatment tubular.

21 Claims, 3 Drawing Sheets

COMPLETION SYSTEM AND METHOD FOR COMPLETING A WELLBORE

BACKGROUND

1. Field of the Disclosure

The disclosure relates generally to apparatus and methods for control of fluid flow between subterranean formations and a tubular string in a wellbore.

2. Background of the Art

To form a wellbore or borehole in a formation, a drilling assembly (also referred to as the "bottom hole assembly" or the "BHA") carrying a drill bit at its bottom end is conveyed downhole. The wellbore may be used to store fluids in the formation or to obtain fluids, such as hydrocarbons, from one or more production zones in the formation. Several techniques may be employed to stimulate hydrocarbon production.

Production and stimulation systems typically have a plurality of concentric tubulars to provide desired production or stimulation functionalities. Production and stimulation rates through the tubulars can be generally increased by increasing the diameters of the tubulars. In addition, it is well established that certain radial clearances between the outer dimension of the screen assembly and the inner dimension of the casing (or other tubular string) in which the screen assembly is positioned must be maintained in order to support stimulation and/or production at appropriate rates. Production and stimulation flow rates may be further reduced due to spacing that can be required between tubulars to run a control line that controls and/or communicates with various devices downhole.

SUMMARY

In one aspect, a system includes a casing disposed in a wellbore in a formation, an installed tubular disposed within the casing and a treatment tubular disposed within the installed tubular, wherein no control line is provided in the treatment tubular, installed tubular or casing. The system also includes a communication line that is placed within the stimulation tubular after the treatment tubular is positioned in the wellbore, wherein the communication line has a sensor to be placed proximate an area of interest within the treatment tubular.

In another aspect, a method for completing a wellbore in a formation includes disposing an installed tubular in a wellbore and disposing an inner tubular within the installed tubular, wherein the inner tubular and installed tubular do not have a communication line to a surface of the wellbore. The method also includes placing a communication line within the inner tubular after the inner tubular is positioned in the wellbore, the communication line having a sensor to be placed proximate an area of interest within the inner tubular, wherein the communication line is not coupled to the stimulation tubular as the inner tubular is run in the installed tubular.

BRIEF DESCRIPTION OF THE DRAWINGS

The disclosure herein is best understood with reference to the accompanying figures in which like numerals have generally been assigned to like elements and in which.

DETAILED DESCRIPTION OF THE DRAWINGS

Figure 1:
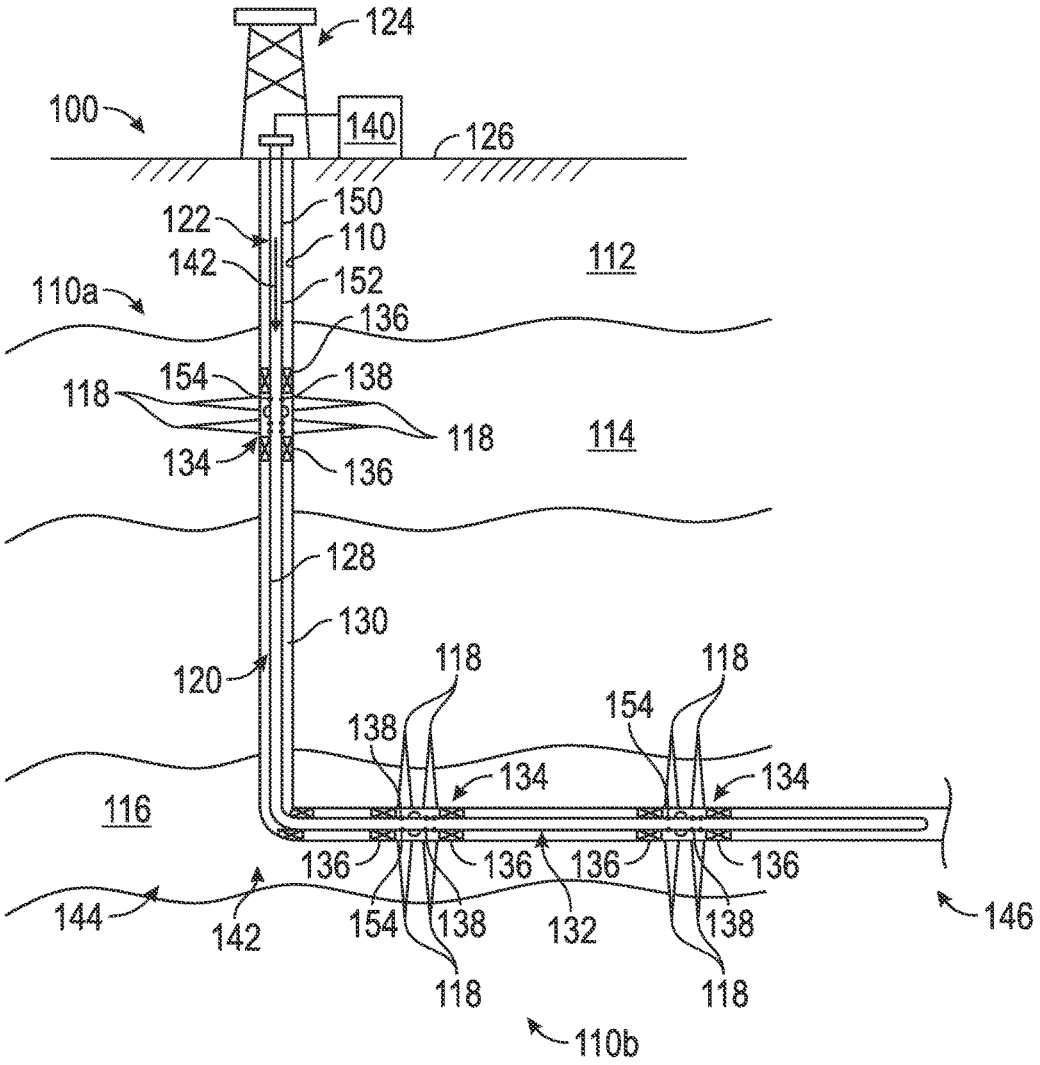
FIG. 1 is a schematic view of an embodiment of a completion system that includes an installed tubular, inner tubular and communication line.

Referring initially to FIG. 1, there is shown an exemplary wellbore system 100 that includes a wellbore 110 drilled through an earth formation 112 and into production zones or reservoirs 114 and 116. The wellbore 110 is shown lined with an optional casing having a number of perforations 118 that penetrate and extend into the formation production zones 114 and 116 so that formation fluids or production fluids may flow from the production zones 114 and 116 into the wellbore 110. The exemplary wellbore 110 is shown to include a vertical section 110*a* and a substantially horizontal section 110*b*. The wellbore 110 includes a string (or production tubular) 120 that includes a tubular assembly (also referred to as the "tubular string", "completion string" or "completion system") 122 that extends downwardly from a wellhead 124 at surface 126 of the wellbore 110. The string 120 defines an internal axial bore 128 along its length. An annulus 130 is defined between the string 120 and the wellbore 110, which may be an open or cased wellbore depending on the application. The exemplary tubular assembly 122 includes an inner tubular 150 disposed within an installed tubular 152, where the inner tubular 150 may be a stimulation tubular that is run into the wellbore 110 after the installed tubular 152 is installed. In embodiments, the inner tubular 150 is a production tubular that is run into the wellbore 110 after the stimulation process is complete and the stimulation tubular is removed.

The string 120 is shown to include a generally horizontal portion 132 that extends along the deviated leg or section 110*b* of the wellbore 110. Flow control assemblies 134 are positioned at selected locations along the string 120. Optionally, each flow control assembly 134 may be isolated within the wellbore 110 by packer devices 136. Although only two flow control assemblies 134 are shown along the horizontal portion 132, a large number of such flow control assemblies 134 may be arranged along the horizontal portion 132. Another flow control assembly 134 is disposed in vertical section 110*a* to affect production from production zone 114. In addition, a packer 142 may be positioned near a heel 144 of the wellbore 110, wherein element 146 refers to a toe of the wellbore. Packer 142 isolates the horizontal portion 132, thereby enabling pressure manipulation to control fluid flow in wellbore 110.

As depicted, each flow control assembly 134 includes equipment configured to control fluid communication between a formation and a tubular, such as string 120. In an embodiment, flow control assemblies 134 include one or more flow control apparatus or valves 138 to control flow of one or more fluids (e.g., hydraulic fracturing fluids) from the string 120 into the production zones 114, 116. A fluid source 140 is located at the surface 126, wherein the fluid source 140 provides pressurized fluid via string 120 to the flow control assemblies 134. Accordingly, each flow control assembly 134 may provide fluid to one or more formation zone (114, 116) to induce fracturing of production zones proximate the assembly. As described in further detail below, the flow control assembly 134 includes a communication line 154 disposed within the inner tubular 152, where the inner tubular 152 and installed tubular 150 do not include and are not coupled to communication or power lines.

In other embodiments, the flow control assembly 134 may inject fluids to induce flow of formation fluid to a nearby wellbore. In yet another embodiment, the flow control assembly 134 may be a production assembly control flow of formation fluid into the string 120. In an embodiment, injection fluid, shown by arrow 142, flows from the surface 126 within string 120 (also referred to as "tubular" or "injection tubular") to flow control assemblies 134. Injection apparatus 138 (also referred to as "flow control devices" or "valves") are positioned throughout the string 120 to distribute the fluid based on formation conditions and desired production.

Figure 2A:
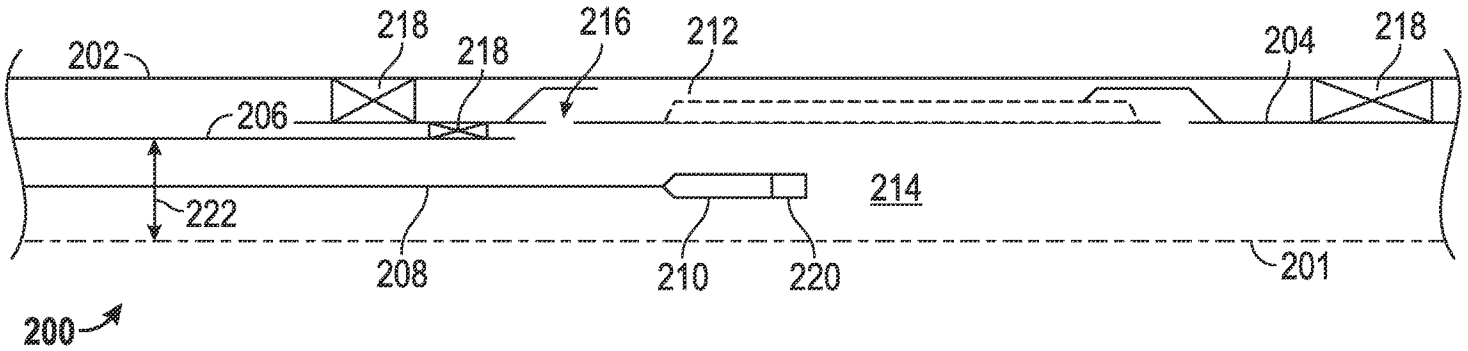
FIGS. 2A, 2B and 3 show cross-sectional views of a completion system according to embodiments.
Figure 2B:
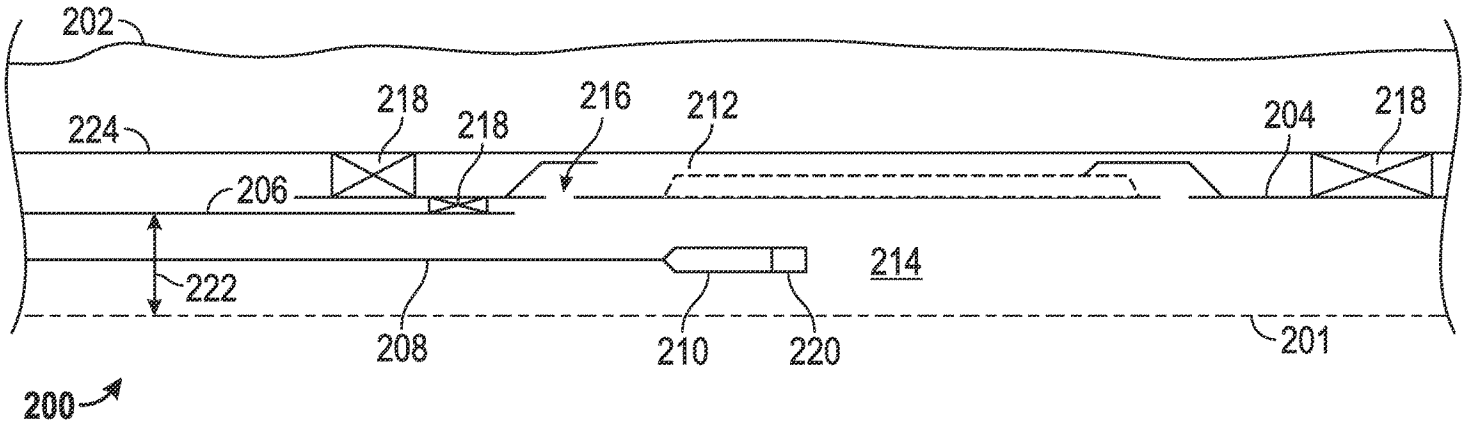

FIGS. 2A and 2B show cross-sectional views of a completion system 200 according to embodiments. FIG. 2A shows the completion system 200 in an open hole environment. FIG. 2B shows the completion system 200 in a wellbore 202 with a casing 224. The illustrated embodiments show one half of the completion system 200, where a substantially similar half (not shown) is located on the other side of a centerline 201. The system 200 is positioned in the wellbore 202, where the wellbore may be a cased wellbore or an open hole wellbore. In an embodiment, an installed tubular 204 is disposed in the wellbore as part of a completion operation. An inner tubular 206 is disposed within the installed tubular 204, where the inner tubular 206 may be part of an injection string or a production string. Portions of the wellbore 202 may be sealed and/or isolated by placement of packers 218 between the installed tubular 204, inner tubular 206 and wellbore 202. After the inner tubular 206 is positioned within the installed tubular 204, a communication line 208 is run into an interior of the inner tubular 206, where the communication line 208 is not attached or coupled to the inner tubular 206. A sensor device 210 is positioned at the end of the communication line 208, where the sensor device 210 is configured to determine at least one parameter including, but not limited to, temperature, pressure, location and water content. In embodiments, the inner tubular 206 may be referred to as a treatment tubular that may be used to perform operations, such as injection, stimulation, production and fracking.

In embodiments, the sensor device 210 includes, but is not limited to the following sensors: electronic PT, electronic and/or fiber optic flowmeters, electro magnetism, resistivity, chemical sensing, tomography, fluid sampling and analysis, distributed temperature sensing, DDTS (Distributed Discreet Temperature Sensing done with fiber optics and/or electronic gauges), strain, distributed acoustic sensing, distributed pressure, gamma ray, density log (Magnetic Resonance), mud logging (for pore pressure information), seismic (3D and 4D) and microseismic, monitoring electric submersible pumps, torque, drag, azimuth, inclination, RF identification, proximity sensing (i.e. to open/close sleeves), neutron doping measurement (used for propant placement), standard MWD measurements (natural gamma ray, directional survey, tool face, borehole pressure, temperature, vibration, shock, torque, formation pressure, formation samples), chemical analysis/fluid property, level monitoring, fluid viscosity, electrical logs (resistivity, image log), porosity logs, and fluid density.

In an aspect, the installed tubular 204 includes a screen 212 or other suitable flow control or filtering device, where the screen 212 controls flow of fluids between the wellbore 202 and the installed tubular 204. In embodiments, the screen 212 may prevent particles of a selected size from flowing through the screen. A valve, such as a fracturing valve 216 ("frac valve") may be used to control fluid communication between the installed tubular 204 and the wellbore 202. In an embodiment, the sensor 210 is positioned proximate an area of interest in the wellbore, such as near the frac valve 216 or near a production zone, where the sensor provides information about a fracing or production operation. Other areas of interest may include proximate a screen 212, proximate a valve and proximate a mini frac valve. The information is provided to a user a surface of the wellbore 202 for monitoring and adjusting the operation(s). In embodiments, the communication line 208 includes a shifting tool 220 that may be used to control a position of valves downhole. As depicted, the installed tubular 204 and inner tubular 206 do not have communication and/or power lines running to the surface of the wellbore, thus enabling an increased diameter for the installed tubular 204 and inner tubular 206. Accordingly, the embodiments provide increased diameters for production tubing which causes increase production from the wellbore 202. In an embodiment, the installed tubular 204 and inner tubular 206 are positioned downhole before the communication line 208 is placed in the wellbore. The installed tubular 204 and inner tubular 206 do not include control lines that are run in along with the tubulars, where control lines are lines used for communicating signals and/or power to selected locations in the wellbore. By not having control lines that are installed or run in with the installed tubular 204 and inner tubular 206, tubular installation is simplified while also increasing an inner diameter 222 of the inner tubular 206. For example, by not having a control line coupled to an exterior or either the installed tubular 204 and inner tubular 206, the tubulars have reduced the annular space between each other and between the installed tubular 204 and the casing 224 or wellbore 202. In an embodiment, maximizing the inner diameter 222 of the inner tubular 206 enables increased flow rates for fluid within the inner tubular 206 during fracing or production.

Figure 3:
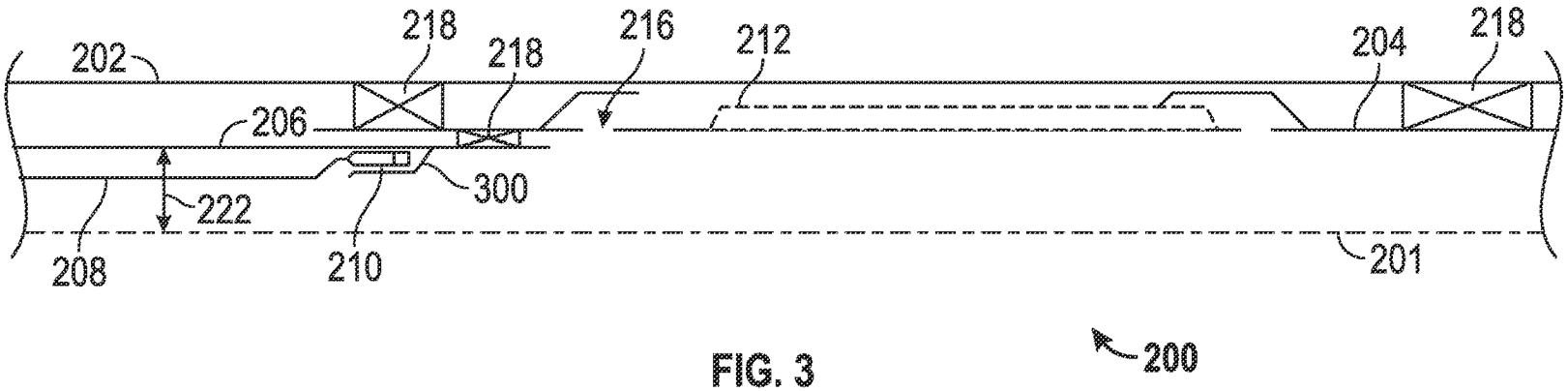

FIG. 3 shows an embodiment cross-sectional view of the completion system 200 having receptacle, such as a side pocket mandrel 300 that receives the communication line 208 and sensor 210 proximate the area of interest (e.g., the frac valve 216). In an embodiment, the communication line 300 is run downhole after the inner tubular 206 is positioned within the installed tubular 204, where it is directed to the side pocket mandrel 300 via a suitable guide or guiding mechanism. As depicted in FIGS. 2 and 3, the use of the separate communication line 300 and absence of power and communication lines between the wellbore 202, installed tubular 204 and inner tubular 206 allows for reduced clearance or spacing between the components of the string, thereby providing an increased inner diameter for a production string to improve hydrocarbon production efficiency and reduce production time. In addition, embodiments of the completion system 300 simplify assembly by positioning the communication line 208 after the inner tubular 206 has been installed. Specifically, in an embodiment where the inner tubular 206 and/or installed tubular 204 are made up from a plurality of tubular segments assembled at the surface as the tubulars are deployed, the assembly of the tubulars is simplified by not having a communication or power line coupled to the tubulars. In embodiments, the sensor 210 and/or communication line 208 include a device, such as a radio frequency identification ("RFID") transmitter/receiver to communicate a location of the communication line 208 to the surface. For example, RFID tags may be located proximate selected locations in the tubulars (e.g., near an area of interest) to identify the location of the communication line 208 within the tubulars.

In an embodiment, the communication line 208 and sensor device 210 is positioned within the side pocket mandrel 300 located uphole of a port, such as frac valve 216. The sensor device 210 monitors fluid flow and other parameters at the location which may experience high flow rates and associated erosion. In an embodiment, sensor devices 210 may be located on the inner tubular 206 or installed tubular 202, where the sensors are powered and are capable of communicating only when the communication line 208 is run downhole. Embodiments of the system provide sensing, communication and intelligence without having the lines or devices located or installed on downhole equipment, such as tubulars, valves or sleeves.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

What is claimed is:

1. A system comprising:

an installed tubular disposed in a wellbore in a formation, the installed tubular including a downhole device;

a treatment tubular disposed within the installed tubular, wherein the treatment tubular includes a side pocket and extends downhole to end at a location above the downhole device of the installed tubular, wherein the treatment tubular is lowered downhole unpowered by a control line and has an inner diameter greater than an inner diameter of a treatment tubular having a control line; and a communication line that is lowered through the treatment tubular after the treatment tubular is positioned in the wellbore, wherein the communication line includes a sensor for measuring a fluid parameter and communicating the measurement to a surface location and a shifting tool for controlling the downhole device, wherein the sensor and shifting tool are lowered into the side pocket to control the downhole device and measure the fluid parameter.

2. The system of claim 1, wherein the communication line is not coupled to the treatment tubular when the treatment tubular is run into the wellbore.

3. The system of claim 1, wherein the downhole device is one of: a frac valve, a screen, a valve and a mini frac valve.

4. The system of claim 1, wherein the sensor is placed proximate the downhole device during a stimulation process or as the communication line is lowered.

5. The system of claim 1, wherein the side pocket mandrel is proximate the downhole device.

6. The system of claim 1, wherein the communication line includes a power line to power the sensor and wherein the sensor comprises a sensor to determine at least one of: temperature, pressure, location and water content.

7. The system of claim 1, wherein the installed tubular and treatment tubular are run in the wellbore without control lines.

8. The system of claim 1, wherein the installed tubular is disposed in a casing disposed in the wellbore.

9. A completion system comprising:

an installed tubular disposed in a wellbore in a formation, the installed tubular having a downhole valve;

an inner tubular disposed within the installed tubular, wherein the inner tubular and the installed tubular are run in the wellbore without a communication line and the inner tubular extends downhole to a location above the downhole valve and includes a side pocket; and the communication line that is run into the inner tubular after the inner tubular is positioned in the wellbore, the communication line including a sensor for measuring a fluid parameter and communicating the measurement to a surface location and a shifting tool for controlling a position of the downhole valve, wherein the sensor and shifting tool are lowered into the side pocket to control the downhole device and measure the fluid parameter, wherein the inner tubular has an inner diameter greater than an inner diameter of a treatment tubular having a control line.

10. The system of claim 9, wherein the inner tubular comprises a treatment tubular and wherein the downhole valve is a frac valve.

11. The system of claim 9, wherein the inner tubular comprises a production tubular and wherein the downhole valve is proximate a production zone.

12. The system of claim 9, wherein the sensor is positioned proximate an end of the communication line.

13. The system of claim 12, wherein the side pocket mandrel is proximate an area of interest.

14. The system of claim 9, wherein the communication line includes a power line to power the sensor.

15. A method for completing a wellbore in a formation, the method comprising:

disposing an installed tubular in a wellbore, the installed tubular including a downhole device;

disposing an inner tubular within the installed tubular, the inner tubular including a side pocket uphole of the downhole device, wherein the inner tubular and the installed tubular are run in the wellbore without a communication line to a surface of the wellbore, wherein the inner tubular extends to a location above the downhole device;

running the communication line into the inner tubular after the inner tubular is positioned in the wellbore, wherein the communication line includes a sensor and a shifting tool for controlling a position of the downhole device; and depositing the sensor and shifting tool in the side pocket of the inner tubular proximate the downhole device, activating the downhole device with the shifting tool, monitoring a fluid parameter with the sensor and communicating the measurement to a surface location, wherein the inner tubular has an inner diameter greater than an inner diameter of a treatment tubular having a control line.

16. The method of claim 15, wherein disposing the inner tubular within the installed tubular comprises disposing an inner tubular within the installed tubular and wherein the downhole device is a frac valve.

17. The method of claim 15, wherein disposing the inner tubular within the installed tubular comprises disposing a production tubular within the installed tubular and wherein the downhole device is proximate a production zone.

18. The method of claim 15, comprising positioning the sensor proximate an end of the communication line.

19. The method of claim 15, wherein the side pocket mandrel is proximate the downhole device.

20. The method of claim 15, wherein placing the communication line comprises placing a power line to power the sensor.

21. The method of claim 15, wherein the sensor comprises a sensor to determine at least one of: temperature, pressure, location and water content.

* * * * *